US011648449B1

(12) United States Patent
Pfeifer et al.

(10) Patent No.: US 11,648,449 B1
(45) Date of Patent: May 16, 2023

(54) COVER FOR THE SHAFT OF ATHLETIC EQUIPMENT

(71) Applicant: Vincent Pfeifer, Altamont, NY (US)

(72) Inventors: Vincent Pfeifer, Massapequa, NY (US); Paul Gait, Altamont, NY (US)

(73) Assignee: Vincent Pfeifer, Massapequa, NY (US)

( * ) Notice: Subject to any disclaimer, the term of this patent is extended or adjusted under 35 U.S.C. 154(b) by 63 days.

(21) Appl. No.: 17/340,698

(22) Filed: Jun. 7, 2021

Related U.S. Application Data

(63) Continuation-in-part of application No. 16/384,460, filed on Apr. 15, 2019, now abandoned, which is a continuation-in-part of application No. 15/498,795, filed on Apr. 27, 2017, now abandoned.

(51) Int. Cl.
*A63B 60/14* (2015.01)
*A63B 59/20* (2015.01)
*A63B 60/16* (2015.01)

(52) U.S. Cl.
CPC ..... *A63B 60/14* (2015.10); *A63B 59/20* (2015.10); *A63B 60/16* (2015.10)

(58) Field of Classification Search
CPC ..... A63B 60/14; A63B 59/20; A63B 60/16
See application file for complete search history.

(56) References Cited

U.S. PATENT DOCUMENTS 2,038,840 A * 4/1936 Hall ..... A63B 53/14 473/298
2,160,656 A * 5/1939 Hall ..... A63B 53/14 473/203
4,185,375 A * 1/1980 Brown ..... A63B 60/06 473/549
5,118,107 A * 6/1992 Bucher ..... A63B 53/14 473/549

(Continued)

*Primary Examiner* — Alvin A Hunter
*Assistant Examiner* — Christopher Glenn
(74) *Attorney, Agent, or Firm* — Thomas M. Galgano; Galgano IP Law PLLC

(57) ABSTRACT

A removable cover for a lacrosse stick of the type having an elongated hollow shaft having an outer surface and an inner surface and an interior channel extending therethrough and a free end portion with an open end which serves as a handle portion of said lacrosse stick. The cover includes an end cap configured and dimensioned to be removably mountable in a friction fit manner on the free end portion of the hollow shaft. The end cap has a head portion and an elongated, resilient hollow body portion attached to said head portion and insertable into the open end of the free end portion of the hollow shaft. A flexible, resilient, membrane-like, tubular sheath is removably mountable on the outer surface of the free end portion of the hollow shaft and is movable thereon between a furled position in which the sheath is rolled longitudinally on and along said free end portion of the hollow shaft onto itself to form a rolled-up tubular sheath disposed adjacent to the end cap, and an unfurled position, in which the rolled-up tubular sheath is unrolled longitudi- (Continued)

nally on and along the outer surface of the free end portion of the hollow shaft. The tubular sheath is dimensioned to create a friction fit when mounted on the hollow shaft. The sheath has a flap which is inserted into the open end and interior channel of the shaft. Both the sheath and the flap are removably secured to the end cap.

21 Claims, 13 Drawing Sheets

(56) References Cited

U.S. PATENT DOCUMENTS 5,145,171 A * 9/1992 Head ..... A63B 60/16
473/549
5,542,676 A * 8/1996 Howe, Jr. ..... A63B 53/14
473/549

* cited by examiner

COVER FOR THE SHAFT OF ATHLETIC EQUIPMENT

CROSS-REFERENCE TO RELATED APPLICATIONS

This application is a continuation-in-part of application Ser. No. 16/384,460, filed Apr. 15, 2019, which in turn is a continuation-in-part application of application Ser. No. 15/498,795, filed Apr. 27, 2017, which is a continuation of application Ser. No. 14/463,168, filed Aug. 19, 2014, now U.S. Pat. No. 9,636,558, issued on May 2, 2017, which is a continuation of application Ser. No. 13/544,081, filed Jul. 9, 2012, now U.S. Pat. No. 8,814,730, issued on Aug. 26, 2014, which is a continuation of application Ser. No. 12/892,144, filed Sep. 28, 2010, now U.S. Pat. No. 8,241,154, issued Aug. 14, 2012, which is a continuation of application Ser. No. 11/975,288, filed on Oct. 18, 2007, now U.S. Pat. No. 7,828,680, issued on Nov. 9, 2010, which claims the benefit of priority from U.S. Provisional Patent Application No. 60/852,777, filed Oct. 19, 2006, the contents of each of which are hereby incorporated herein by reference.

BACKGROUND OF THE INVENTION

FIELD OF THE INVENTION

This invention relates broadly to sporting or athletic equipment. More particularly, this invention relates to athletic equipment used in competitive team sports such as a lacrosse, field hockey or hockey stick, each of which has a relatively long shaft with a free end at one end and a working end at its other. The free end of the shaft and a substantial portion of the long shaft of such sticks are used by the athlete to hold and grip the shaft with his or her two hands spaced apart along the shaft typically "hip-wide" apart. In lacrosse the working end of the stick is a netted head to catch and throw a ball, in field hockey the working end is a curved head to scoop or hit a ball and in ice hockey the working end is a blade to shoot, pass or carry a puck across the ice. The present invention especially relates to a removable sheath-like cover for the hand-held shaft of athletic equipment of the type such, as, e.g., a lacrosse stick, field hockey stick or hockey stick, to provide a better gripping surface along its shaft for the athlete's hands.

STATE OF THE ART

Lacrosse is a team sport that is played with either ten players(men's field), six players (men's box), or twelve players (women's field), each of whom uses a netted stick (the crosse) in order to pass and catch a hard rubber ball with the aim of scoring goals (each worth one point traditionally, but Major League Lacrosse uses a two point goal for goals scored from a distance of 16 yards or greater from the goal) by propelling the ball into the opponent's goal. The team scoring the most points after two halves, of varying length from competition to competition, and overtime if necessary, wins.

Most popular in North America, lacrosse is Canada's national summer sport. It has grown in popularity in the United States, becoming the fastest growing sport at the high school and NCAA levels.

Lacrosse sticks generally include a relatively long shaft with a netted head attached to one end of the shaft. The shaft is typically octagonal in cross section and is fitted with an end cap at the end not connected to the netted head.

Traditionally, lacrosse sticks have been made of wood, although today most are made from metals such as aluminum or alloys and/or composites. The players or manufacturers typically wrap the shaft with tape. The tape enhances the grip of the stick and, in the case of wood sticks, also tends to protect the player from splinters. However, the tape is generally unsightly and attracts dirt. When removed, it leaves behind a sticky residue. Many players find themselves replacing the tape frequently.

Notwithstanding the problems associated with the use of tape, lacrosse players at every level of the game have been taping their lacrosse sticks for over five decades without a better solution in sight. In fact, in an article written by Matt DaSilva under the heading "CLASSROOM EQUIPMENT TIPS" appearing in the September, 2006 issue of *LaCrosse* magazine, the author talks about Jimmy Butter, a longtime equipment manager from Team USA when it embarked on the 2006 International Lacrosse Federation World Championships, who he called "The most respected stringer" in the game and a "sultan of the stick", who's advice on the how's and whys of taping your stick are taught and highlighted in the article. The bottom line is that taping the handle of a lacrosse stick for better grip is the standard practice today.

Accordingly, it is an object of the present invention to provide a sports equipment stick for team sports, especially the shaft of a lacrosse stick, with a sheath-like cover which improves one's grip and avoids the problems of the prior art.

It is a further object of the present invention to provide such a cover which is lightweight, easy and facile to use, and is relatively inexpensive.

It is another object of the present invention to provide such a cover that can absorb impact and shock and minimize splinters in wood shafts.

It is yet a further object of the invention to provide such a cover which facilitates imprinting with team names, colors, slogans, inspirational sayings or advertising.

SUMMARY OF THE INVENTION

Certain of the foregoing and related objects are attained according to the invention by the provision of a cover for a lacrosse stick, comprising a base cap and a rolled flexible tubular sheath coupled to said base cap, wherein said rolled sheath is configured so that it can be unrolled onto the shaft of a lacrosse stick with the base cap abutting and mounted on the end of the shaft.

Preferably, the sheath is cylindrical, has a pebbled texture on its outer surface and/or is made from a flexible elastic polymer. Desirably, the base cap is cup-shaped.

In a preferred embodiment, a cover for a lacrosse stick comprises a rolled flexible tubular sheath configured so that it can be unrolled onto the shaft of a lacrosse stick, said sheath having a pebbled texture on its outer surface. The sheath is also preferably cylindrical and/or made from a flexible elastic polymer.

Certain of the foregoing and related objects are also attained according to the invention by the provision of a kit comprising a lacrosse stick having a shaft and a netted head and a rolled flexible tubular sheath configured so that it can be unrolled onto the shaft of said lacrosse stick. The kit advantageously further comprises a cup-shaped cap coupled to said sheath. Most desirably, said cap is integrally formed with said sheath and said sheath is cylindrical.

In yet a further embodiment of the invention, a cover for athletic equipment having a shaft comprises a base cap and a rolled flexible tubular sheath coupled to said base cap, wherein said rolled sheath is configured so that it can be unrolled onto the shaft with the base cap abutting and mounted on the end of the shaft. Here, too, the sheath is preferably cylindrical and has a pebbled texture on its outer surface and/or is made from a flexible elastic polymer. The base cap is desirably cup-shaped.

As noted above, the present invention provides a preferably unitary cap and rolled sheath cover. The cap is mounted on the free end or butt of a lacrosse stick and the sheath is unwrapped or unrolled onto the stick to the desired length or the entire length of the stick. The cap and sheath are preferably made from injection molded rubber, neoprene or other polymers that permit production in various thickness, colors and lengths. The elasticity of the material preferably gives it memory and durability. The diameter of the sheath is preferably smaller than the diameter of the lacrosse stick so that it stretches to a tight fit. After the sheath is unrolled to the desired length, excess material may be cut off, if desired.

As further noted above, the sheath is preferably provided with a pebbled texture. The pebbled texture enhances grip and channels away moisture. This also enhances player performance in wet weather conditions. The material is also temperature neutral so that it can enhance performance in cold weather conditions. The invention eliminates the need for tape and makes old lacrosse sticks look new again. The sheath can be quickly and easily removed from a lacrosse stick for use on another stick or for storage until used again. Unlike tape, the invention does not leave behind any damaging residual adhesive.

According to alternate embodiments of the invention, the sheath is color coordinated to team colors. The sheaths may also be imprinted with, e.g., team names, slogans, inspirational sayings or advertising.

Certain of the foregoing and related objects are also attained according to the present invention by the provision of a removable cover for athletic equipment in the form of a stick used in competitive sports having a shaft with a free end which is intended to be held by both hands of a player during play, comprising a cap configured and dimensioned for removably mounting on the free end of the shaft of the athletic equipment, wherein said cap is generally cup-shaped and comprises a generally planar end wall with an outer peripheral edge and a generally tubular upstanding side wall having a first end and a second end, said first end of said side wall being attached to said end wall generally adjacent to said outer peripheral edge of said end wall; and a flexible, resilient membrane-like tubular sheath which is configured and dimensioned to be rolled over onto itself to form a rolled configuration and having two opposite ends, one end of which is attached to said side wall of said cap and the other end of which defines a free end, wherein said tubular sheath is dimensioned and configured so that it can be unrolled longitudinally onto and along the shaft of the athletic equipment with said cap abutting and mounted on the free end of the shaft and said tubular sheath being dimensioned and configured to afford a tight friction fit over the shaft when unrolled and which can be rolled longitudinally in the opposite direction along the shaft towards its free end and onto said sidewall of said cap when fully rolled up, to permit removal of said cap and sheath from the free end of the shaft of the athletic equipment, and wherein the end wall and said side wall of said cap have a thickness which is greater than the thickness of said tubular sheath. Desirably, the sheath has a thickness less than ¼ of an inch. Most desirably, the sheath has a thickness in the general range of between about 0.010 and 0.050 inches and in a preferred range of about 0.025 to 0.035 and ideally about 0.030 inches.

In a preferred embodiment, the sheath is cylindrical and made from a flexible elastic polymer. The sheath may be imprinted. It also may have a textured outer surface. Moreover, it may be integrally formed with the cap. Alternatively, one end of said sheath may be attached to said cap or sidewall thereof via a friction fit.

In a further embodiment of the invention, the second end of said sidewall of said cap is slotted to define a plurality of fingers to facilitate mounting the cap on the free end of the shaft. Preferably, the sidewall has a recessed annular section between said first and second ends thereof and a relatively rigid, annular reinforcement ring at least partially received in said recessed annular section of said sidewall. Desirably, the ring is metallic.

Advantageously, the outer peripheral edge of said end wall extends radially beyond the peripheral edge of said sidewall thereof to define a peripherally-extending knob which is configured and dimensioned to abut the free end of the shaft of the athletic equipment. Preferably, the tubular sidewall has an octagonal cross-section or another polygonal cross-section.

Most desirably, the sheath is adhesive-less or the adhesive is applied only to the inner end of the sheath so it is adhesively affixed to the end cap.

Most advantageously, the tubular sheath is made of a stretchable material which has an inner diameter or width no greater than the diameter or width of the shaft of said athletic equipment so that said sheath stretches to a tight friction fit over the shaft when unrolled.

Most advantageously, the athletic equipment is a lacrosse stick, hockey stick, or field hockey stick used in team sports.

Certain of the foregoing and related objects are also attained according to the present invention by the provision of a method for removably attaching a removable cover for athletic equipment of the type described above which method comprises the steps of mounting the flexible resilient membrane-like tubular sheath in a rolled up configuration onto said sidewall of said cap; mounting said cap onto a free end of said shaft of the stick with said cap abutting and mounted on the free end of the shaft; and unrolling said sheath mounted on said cap longitudinally and directly onto and along the shaft of said stick.

Preferably, the method additionally including the steps of rolling up said sheath mounted on said shaft of said stick in the opposite longitudinal direction such that it is rolled over onto itself to form a rolled up configuration and is thereby again mounted on said sidewall of said cap, and removing said cap and rolled up sheath from said free end of said shaft of the stick.

The method is advantageously used with either a lacrosse stick, a field hockey stick or an ice hockey stick.

Additional objects and advantages of the invention will become apparent to those skilled in the art upon reference to the detailed description taken in conjunction with the provided figures.

Certain of the foregoing and related objects are also attained according to the present invention by the provision of a removable cover for a lacrosse stick of the type having an elongated hollow shaft having an outer surface and an inner surface and an interior channel extending therethrough and a free end portion with an open end which serves as a handle portion of said lacrosse stick, comprising an end cap configured and dimensioned to be removably mountable in a friction fit manner on said free end portion of said hollow shaft, said end cap having a head portion and an elongated, resilient hollow body portion attached to said head portion and insertable into said open end of said free end portion of said hollow shaft; and a flexible, resilient, membrane-like, tubular sheath removably mountable on said outer surface of said free end portion of said hollow shaft and movable thereon between a furled position in which said sheath is rolled longitudinally on and along said free end portion of said hollow shaft onto itself to form a rolled-up tubular sheath disposed adjacent to said end cap, and an unfurled position, in which said rolled-up tubular sheath is unrolled longitudinally on and along said outer surface of said free end portion of said hollow shaft, said tubular sheath being dimensioned and configured to create a friction fit when mounted on and along said free end portion of said hollow shaft. The open end of said free end portion of said hollow shaft opens onto said interior channel of said hollow shaft, and said tubular sheath has a free end portion at one end thereof which is foldable over said free end of said hollow shaft and insertable into said interior channel thereof so that it forms a flap which covers and lies over said inner surface of said free end portion of said hollow shaft.

In addition, end cap head is removable securable to said tubular sheath and said foldable end portion thereof and said end cap body portion is configured and dimensioned to resiliently engage and bias said tubular sheath flap against said inner surface of said free end portion of said hollow shaft.

Preferably, said head portion of said end cap is substantially donut-shaped and has a central opening extending therethrough and said hollow body portion thereof defines an interior through passage opening onto said central opening of said end cap head portion, and wherein said removable cover further comprises a removable plug mountable in a friction fit manner in said central opening of said donut-shaped head portion of said end cap which is dimensioned and configured to lock said end cap in a fixed, non-rotatable manner. Desirably, said plug has a head portion and an elongated shaft portion joined to said head portion. Advantageously, said head portion of said plug is removably mountable in said central opening of said donut-shaped head portion and said elongated shaft portion thereof is insertable into said open end of said free end portion of said hollow shaft and said through passageway of said hollow body portion of said end cap, said elongated shaft portion of said plug being dimensioned and configured so that upon insertion it biases said body portion of said end cap against said flap of said resilient tubular sheath and, in turn, against said inner surface of said free end portion of said hollow shaft. It is preferable that said end cap elongated hollow shaft portion comprises a plurality of spaced, apart, flexible, resilient fingers.

In a further preferred embodiment of the invention, said donut-shaped head portion of said end cap has an outer portion with a centrally-disposed, bowl-shaped surface formed therein which defines a concave recess adjacent to, surrounding, and opening onto, said central opening thereof. Desirably, said removable plug has an enlarged head portion which is fully receivable within said concave recess of said head portion of said end cap when mounted thereon and said enlarged head portion of said plug has a substantially flat top surface.

Most advantageously, said plug has a double-step neck portion disposed between and joined to said plug head portion and said plug shaft, said double-step neck portion having an inner step which serves as a stop and which engages said bowl-shaped surface of said end cap when said plug is fully mounted in said end cap and an outer step spaced from said bowl-shaped surface which serves as a tool placement point to aid removal of said plug. Preferably, said donut-shaped head portion of said end cap has an inner portion with a recessed channel by which it is removably mountable in a friction-fit manner on said open end of said free end portion of said elongated hollow shaft so that it grips and holds said free end portion of said sheath disposed on said outer surface of said hollow shaft adjacent to said open end of said free end portion of said elongated hollow shaft and so that it also grips and holds said flap thereof disposed in said interior channel of said elongated hollow shaft against said inner surface of said hollow shaft.

In a particularly preferred embodiment of the invention, said elongated hollow shaft of the lacrosse stick is of the type having an octagonal cross-section, and wherein recessed channel and said central opening of donut-shaped head portion of said end cap are octagonally-shaped and wherein said hollow shaft of said plug has an octagonal cross-section. In addition, said end cap and said plug are made of plastic and said sheath is made of a flexible elastomeric material.

Certain of the foregoing and related objects are also attained according to the invention by the provision of a lacrosse stick comprising: an elongated hollow shaft having a free end portion with an open end which serves as a handle portion of said hollow shaft, said hollow shaft having an outer surface and an inner surface and an interior channel extending therethrough; and which includes a removable cover as described above.

DETAILED DESCRIPTION OF THE PREFERRED AND ILLUSTRATED EMBODIMENTS

Figure 1:
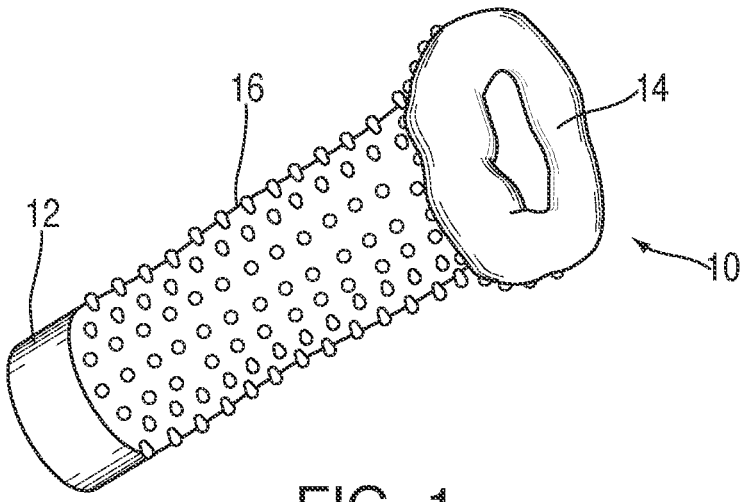
FIG. 1 is a perspective view of a first embodiment of the invention partially unrolled.
Figure 2:
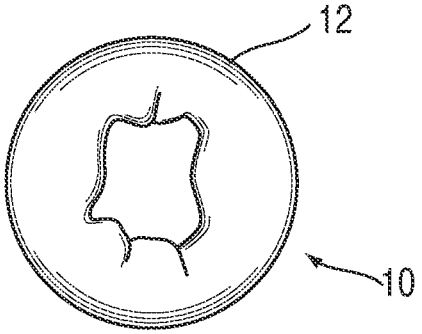
FIG. 2 is a top plan view of the open end of the sheath.
Figure 3:
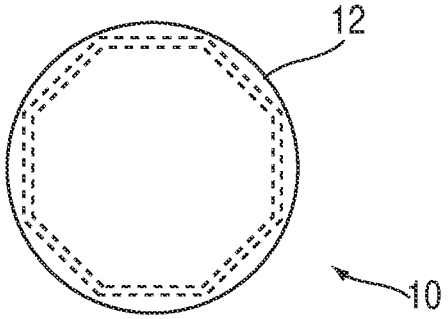
FIG. 3 is a bottom plan view of the end cap with the octagonal end of the lacrosse stick in phantom line.
Figure 4:
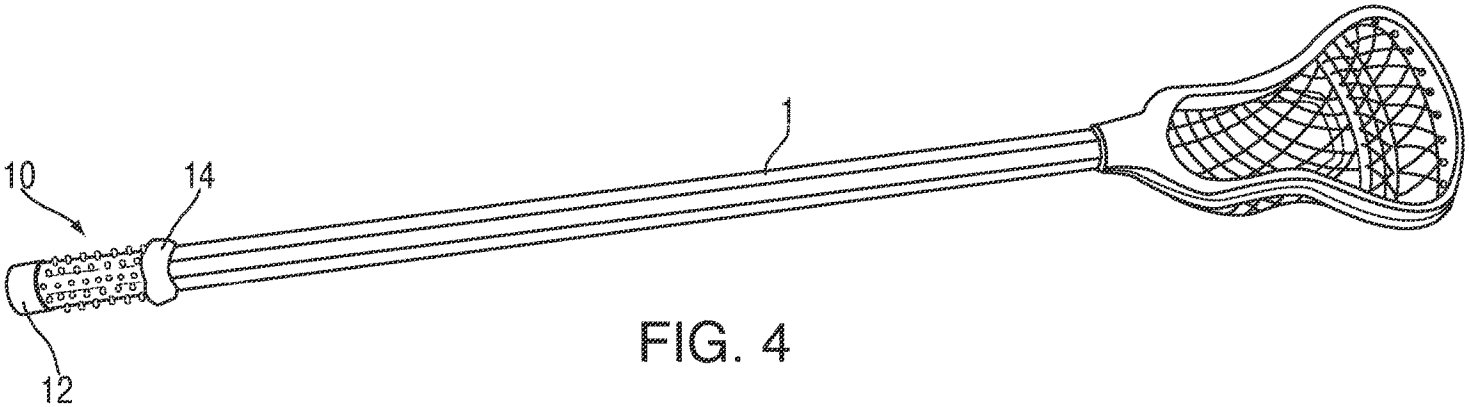
FIG. 4 is a perspective view of a lacrosse stick with the first embodiment of the invention partially installed.
Figure 5:
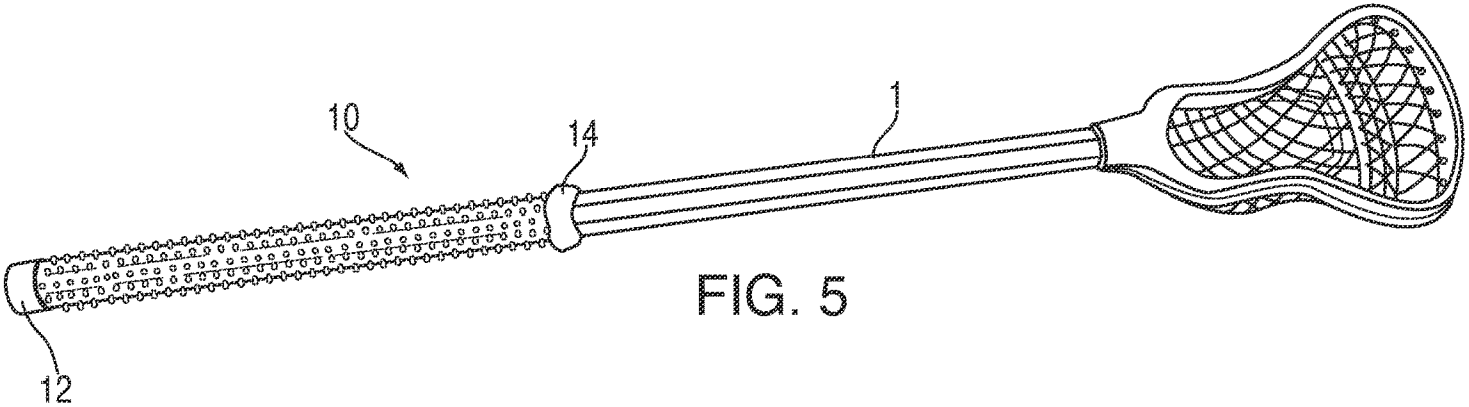
FIG. 5 is a perspective view of a lacrosse stick with the first embodiment of the invention more fully installed.

Turning now to FIGS. 1-3, a cover 10 according to the present invention includes a generally cup-shaped, end cap 12 and a tubular, preferably cylindrical sheath 14 coupled to the open end of the end cap which sheath is normally in a wrapped, furled or rolled state. As shown in FIG. 4, the cap 12 is mounted on the free end or butt of a lacrosse stick 1 in a friction-fit manner and the relatively-thin, resilient, membrane-like sheath 14 is unrolled onto the shaft of stick to a desired length as shown in FIG. 5 or the entire length of the shaft as shown in FIG, 6 to thereby, in effect, provide the shaft with a resilient "skin". The cap 12 and sheath 14 are preferably integrally formed in one piece and made from injection molded rubber, synthetic rubber, neoprene or other synthetic plastic polymers that permit production in various thickness, colors and lengths. The elasticity of the material preferably gives it memory and durability. The sheath 14 and cap 12 are preferably cylindrical and are dimensioned to enable a friction fit on the shaft of the lacrosse stick which, as shown in phantom view in FIG. 3, is typically octagonal. The thickness of the cap 12 may be several times thicker than the thickness of the sheath 14. The diameter of the sheath 14 is preferably smaller than the diameter of the lacrosse stick 1 so that it stretches to a tight fit. After the sheath 14 is unrolled to the desired length, excess material may be cut off, if desired.

According to the presently preferred embodiment, the sheath 14 may provide a pebbled texture 16 on its outer surface. The pebbled texture enhances grip and channels away moisture. This also enhances player performance in wet weather conditions. The material is preferably also temperature neutral so that it can enhance performance in cold weather conditions. The invention eliminates the need for tape and makes old lacrosse sticks look new again. Unlike tape, the invention does not leave behind any damaging residual adhesive. It also improves the safety of the stick as it provides a full sheath to protect the player from splintering wood shafts caused by checking during the game. The sheath can be quickly and easily removed from a lacrosse stick for use on another stick or it can be stored, e.g., in a pouch (not shown) until used again.

Figure 7:
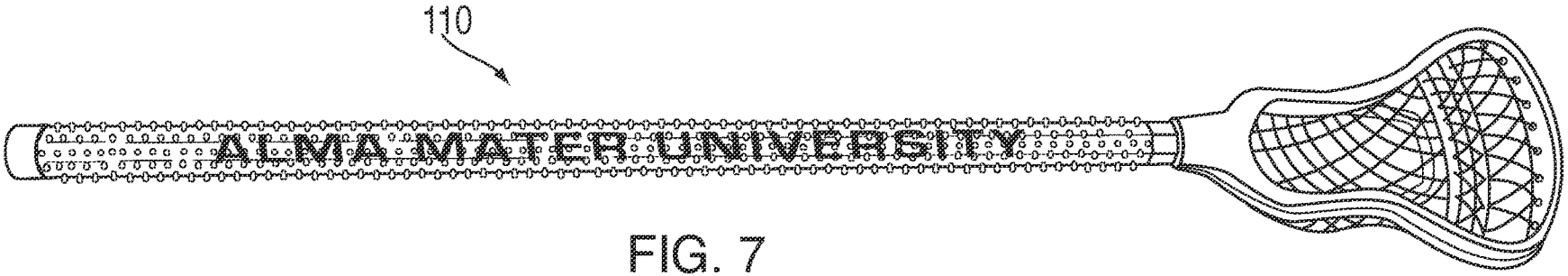
FIG. 7 is a perspective view of a lacrosse stick with a second embodiment of the invention completely installed.
Figure 8:
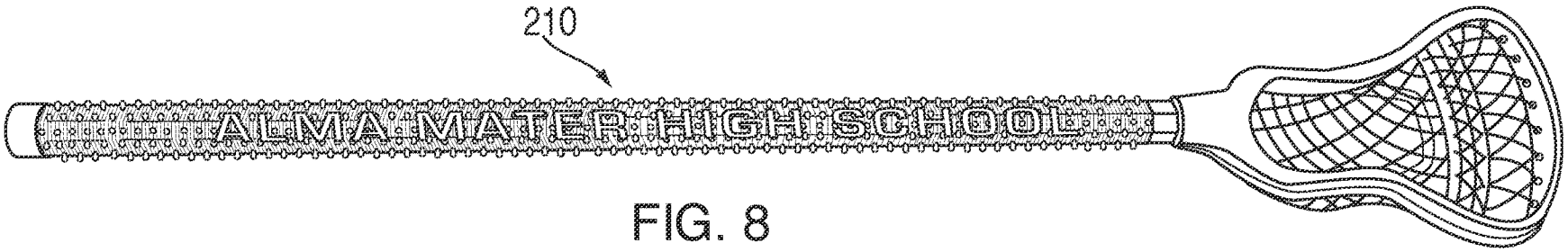
FIG. 8 is a perspective view of a lacrosse stick with a third embodiment of the invention completely installed.
Figure 9:
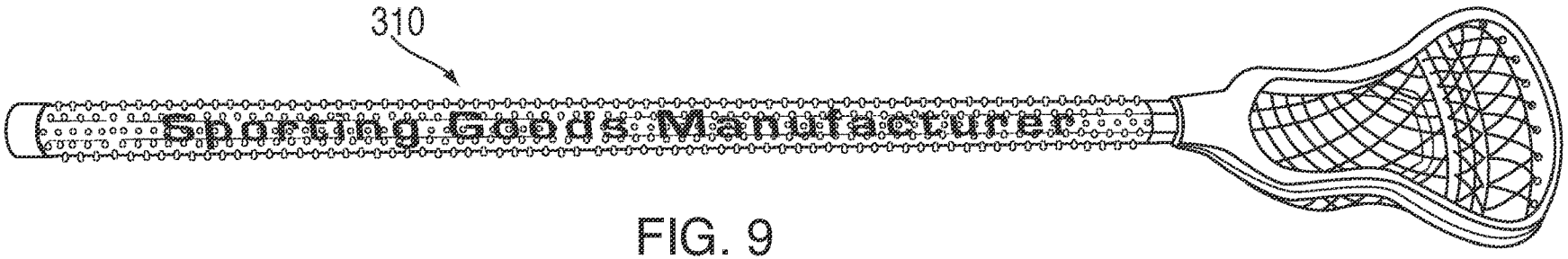
FIG. 9 is a perspective view of a lacrosse stick with a fourth embodiment of the invention completely installed.
Figure 10:
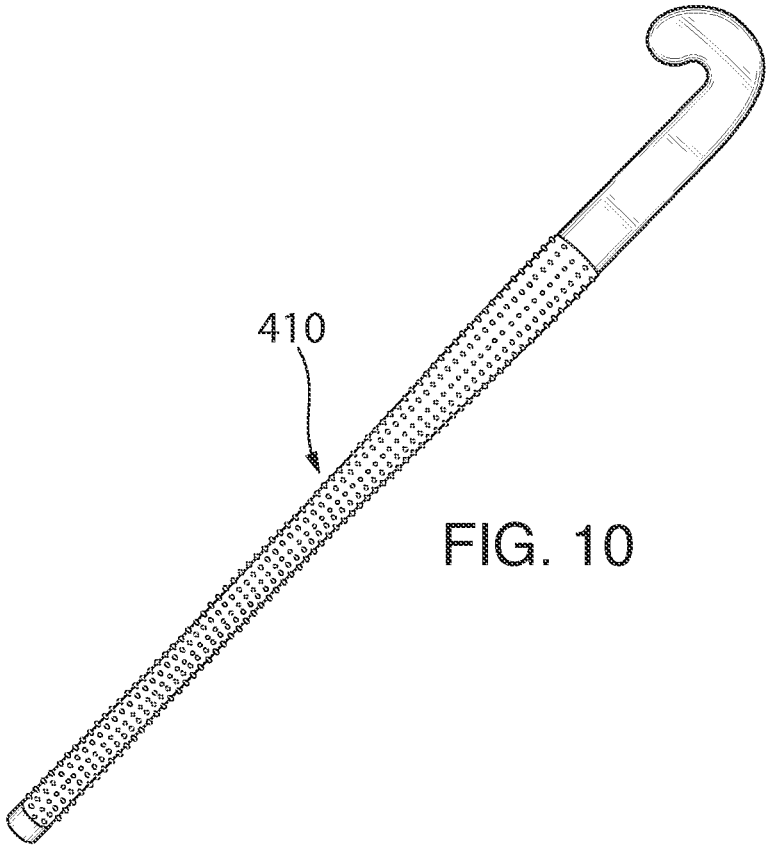
FIG. 10 is a perspective view of a field hockey stick with a fifth embodiment of the invention completely installed.
Figure 11:
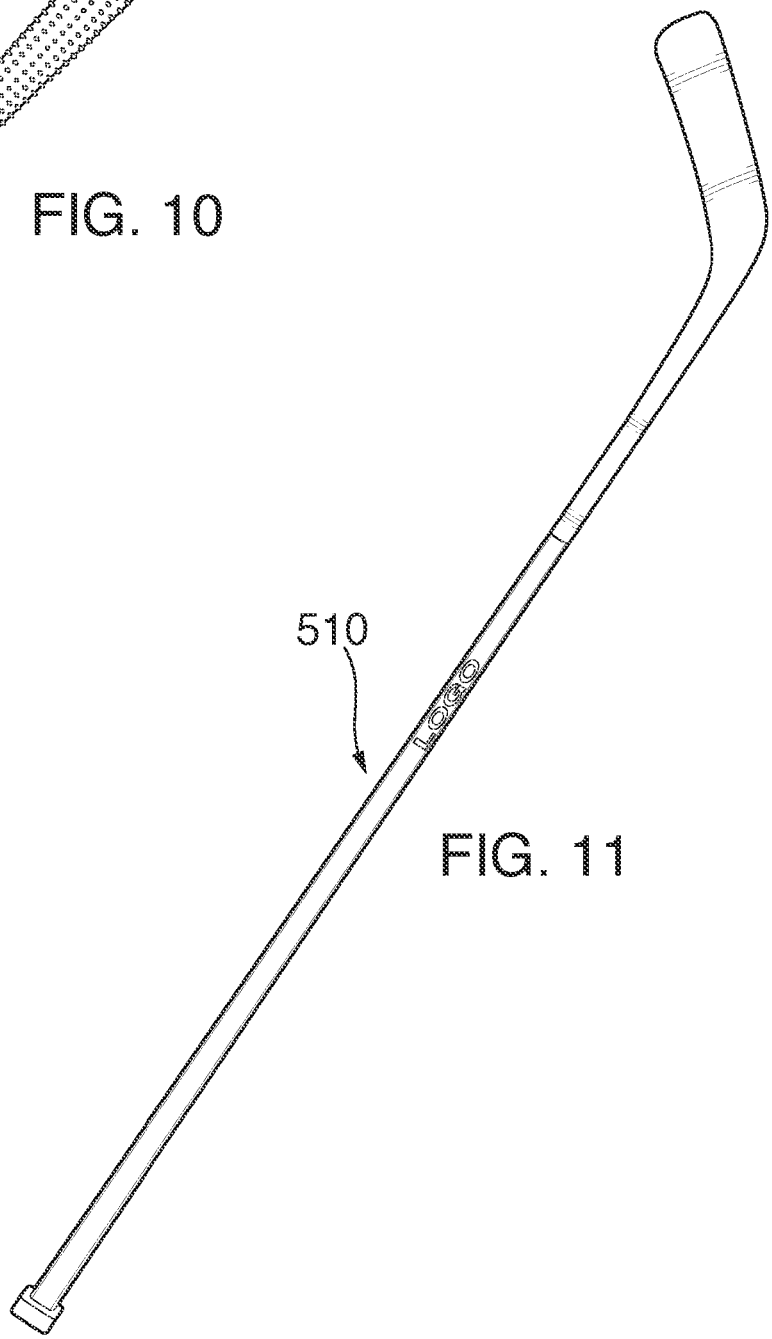
FIG. 11 is a perspective view of an ice hockey stick with a sixth embodiment of the invention completely installed.

According to preferred embodiments of the invention, the color of the sheaths and/or caps is coordinated to the desired team colors. The sheaths may also be imprinted with, e.g., team names, logos, slogans, inspirational sayings or advertising, etc. For example, FIG. 7 shows a second embodiment 110 which is imprinted with the name of a school and is colored to match the school colors. FIG. 8 shows a third embodiment 210 which is colored to match a different school's colors and is imprinted with a different school's name. FIG. 9 shows a fourth embodiment 310 which is imprinted with advertising. FIG. 10 is a perspective view of a field hockey stick with a fifth embodiment 410 of the invention completely installed and FIG. 11 is a perspective view of a hockey stick with a sixth embodiment 510 of the invention completely installed which has a cover on which is imprinted a logo of a team, sponsor, manufacturer of the stick or other associated entity.

Figure 6:
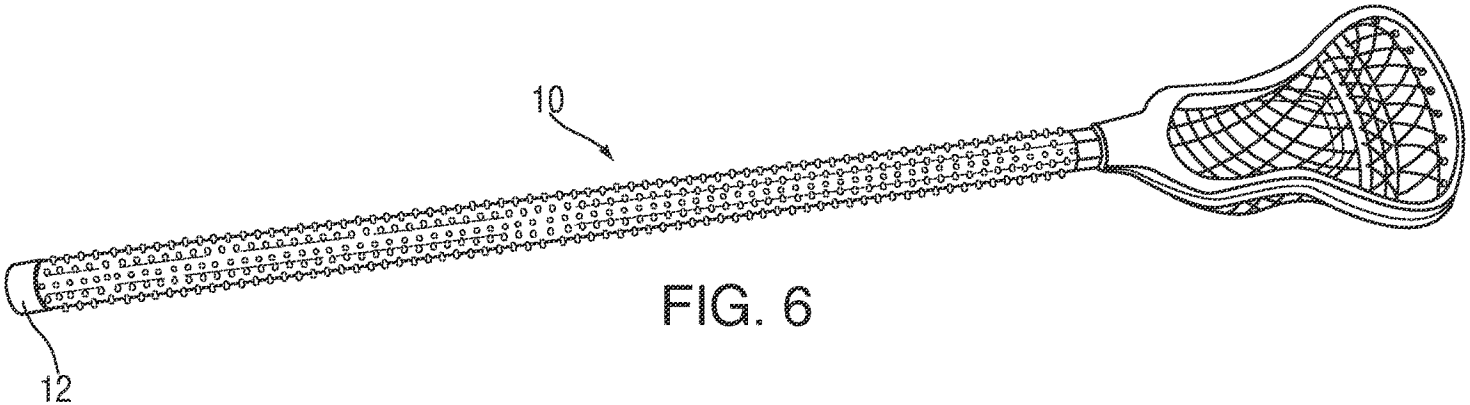
FIG. 6 is a perspective view of a lacrosse stick with the first embodiment of the invention completely installed.
Figure 12B:
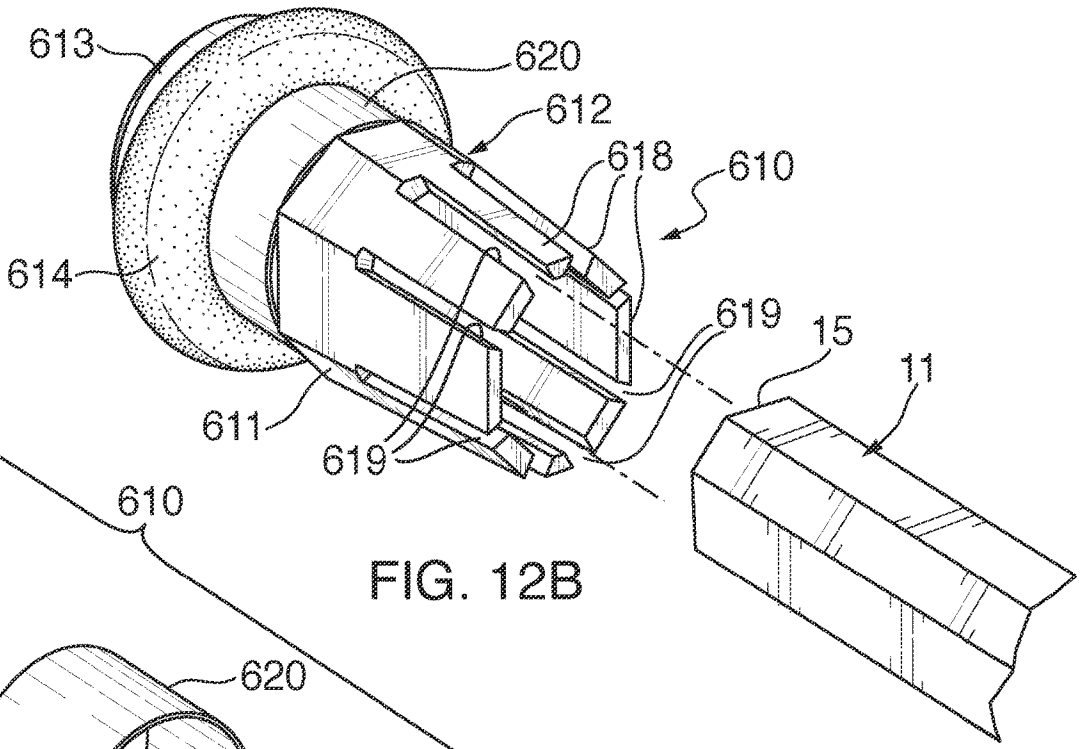
FIG. 12B is a further exploded perspective view of the fully-assembled cover embodying the seventh embodiment of the invention shown in FIG. 12B, together with the fragmentarily-illustrated, free end of a shaft of a lacrosse stick.
Figure 12A:
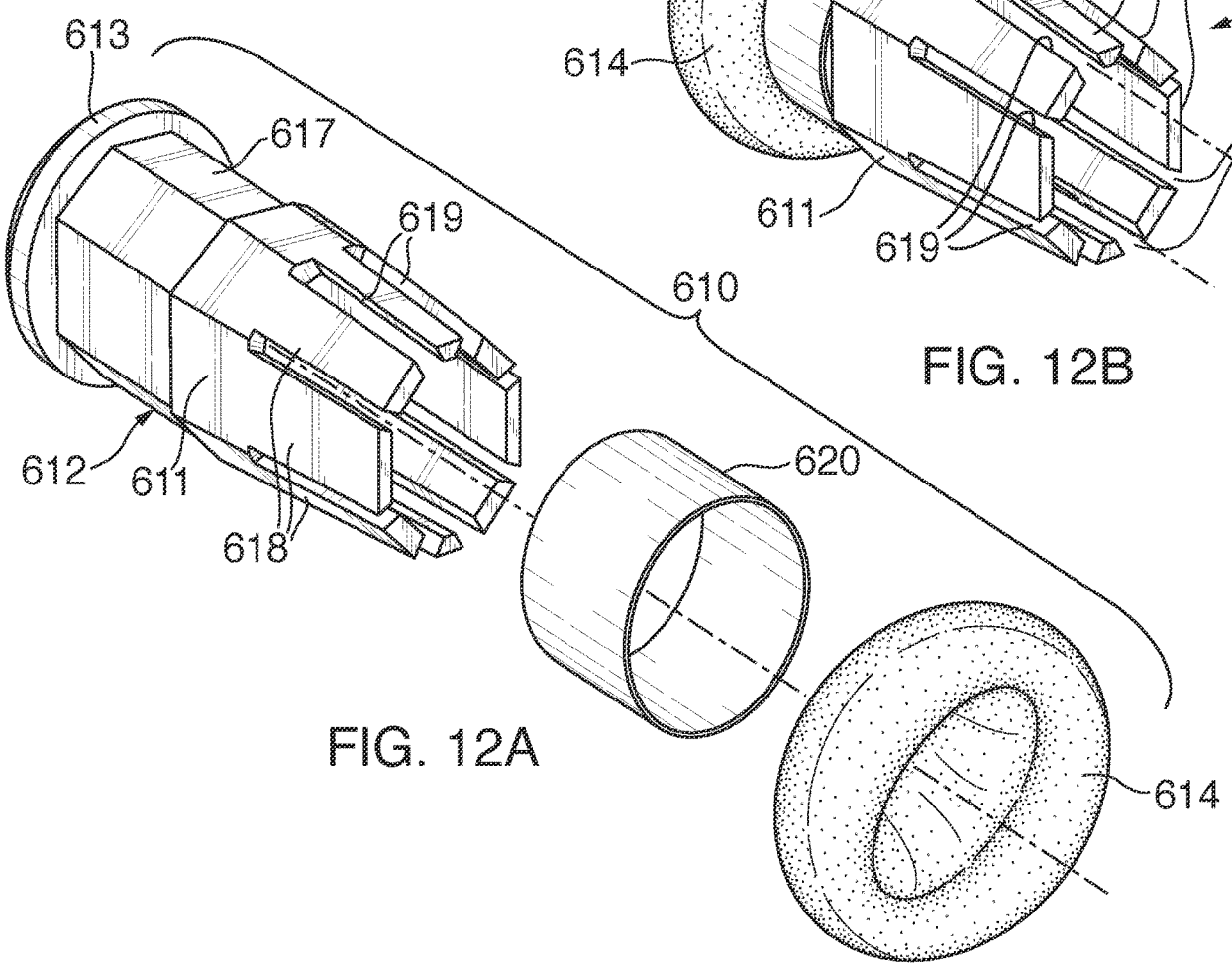
FIG. 12A is an exploded, perspective view of the cover of a seventh embodiment of the invention.
Figure 13:
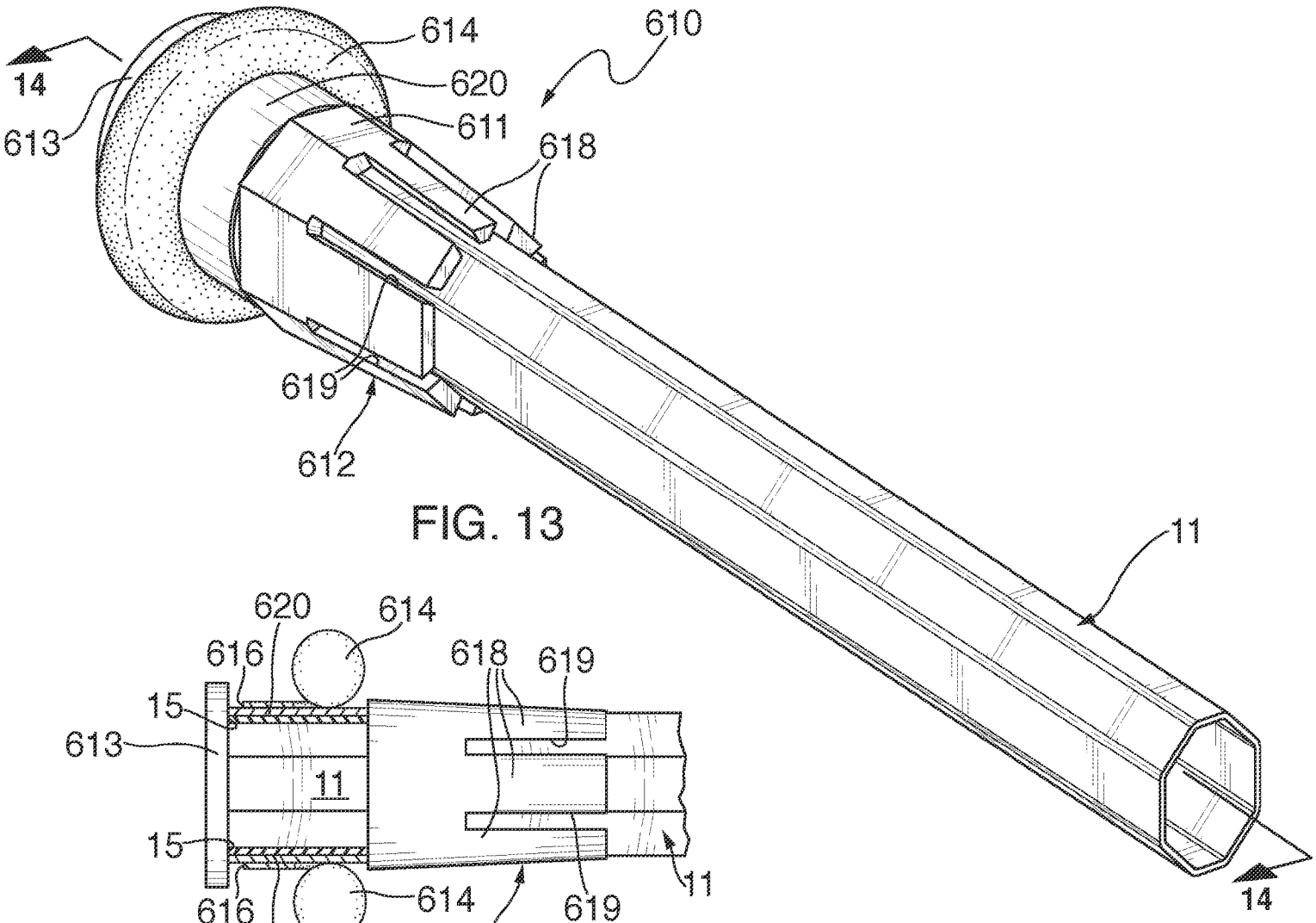
FIG. 13 is a perspective view comparable to that shown in FIG. 12, but showing the fully-assembled cover mounted on the free end of the lacrosse stick shaft.
Figure 14:
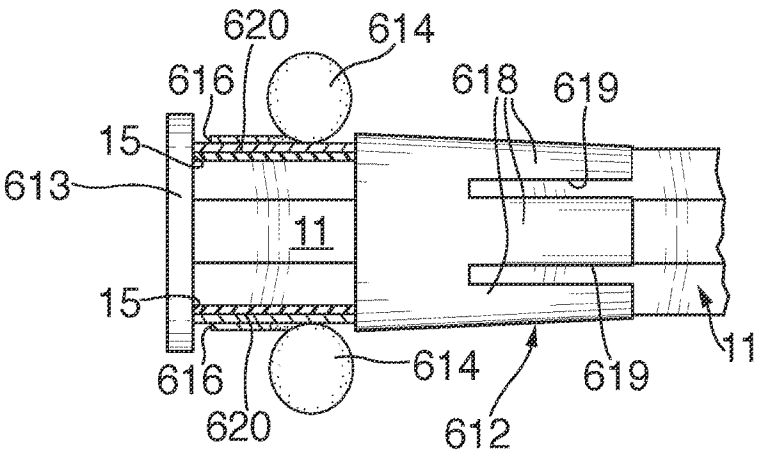
FIG. 14 is a fragmentarily-illustrated, side elevational view, in part section, of the fully-assembled cover mounted on the free end of the lacrosse stick shown in FIG. 13.
Figure 15:
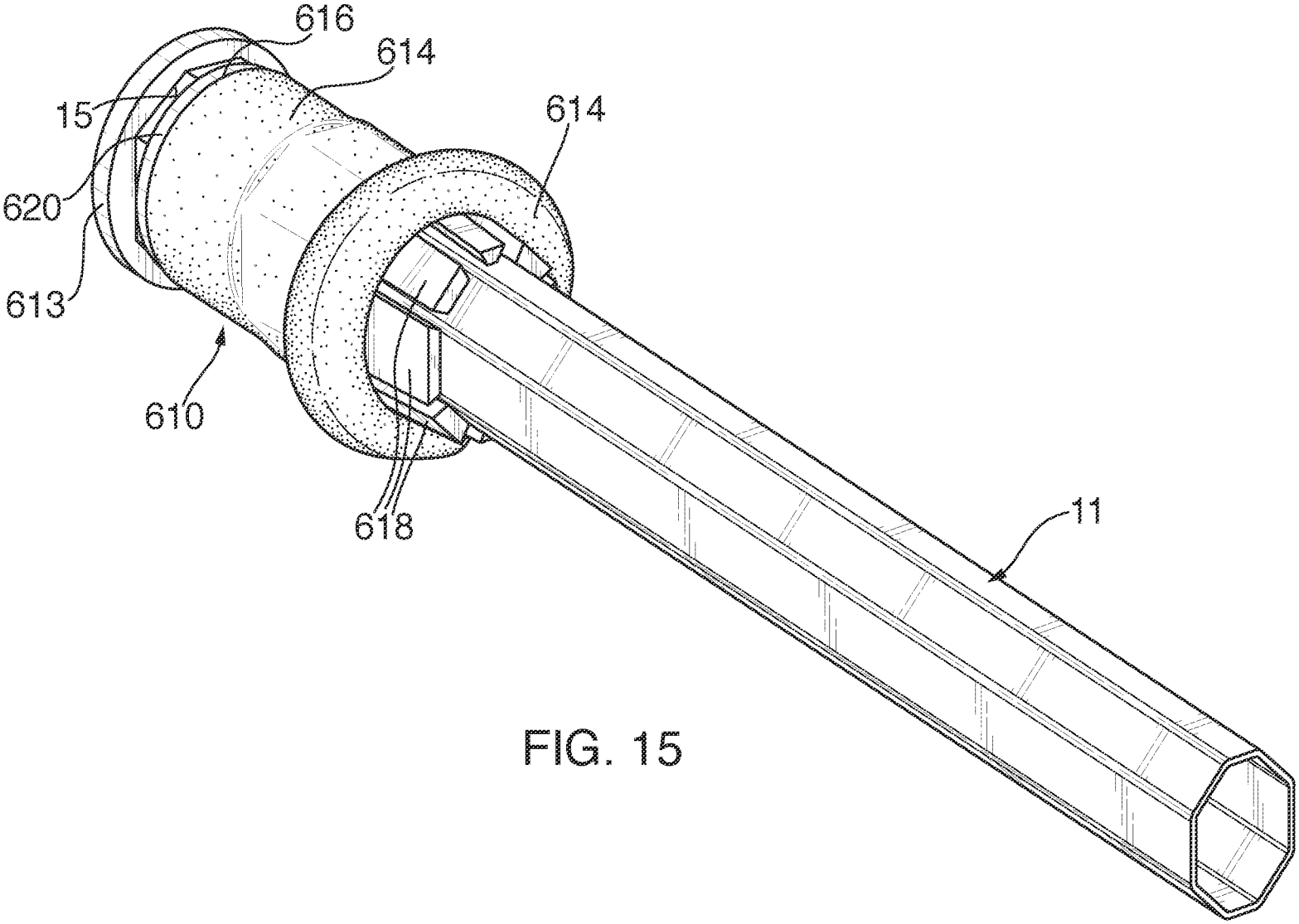
FIG. 15 is a perspective view comparable to FIG. 13, but showing the sleeve as it is initially unrolled and covers most of the sidewall of the cup-shaped cap of the cover mounted on the end of the lacrosse stick shaft.
Figure 16:
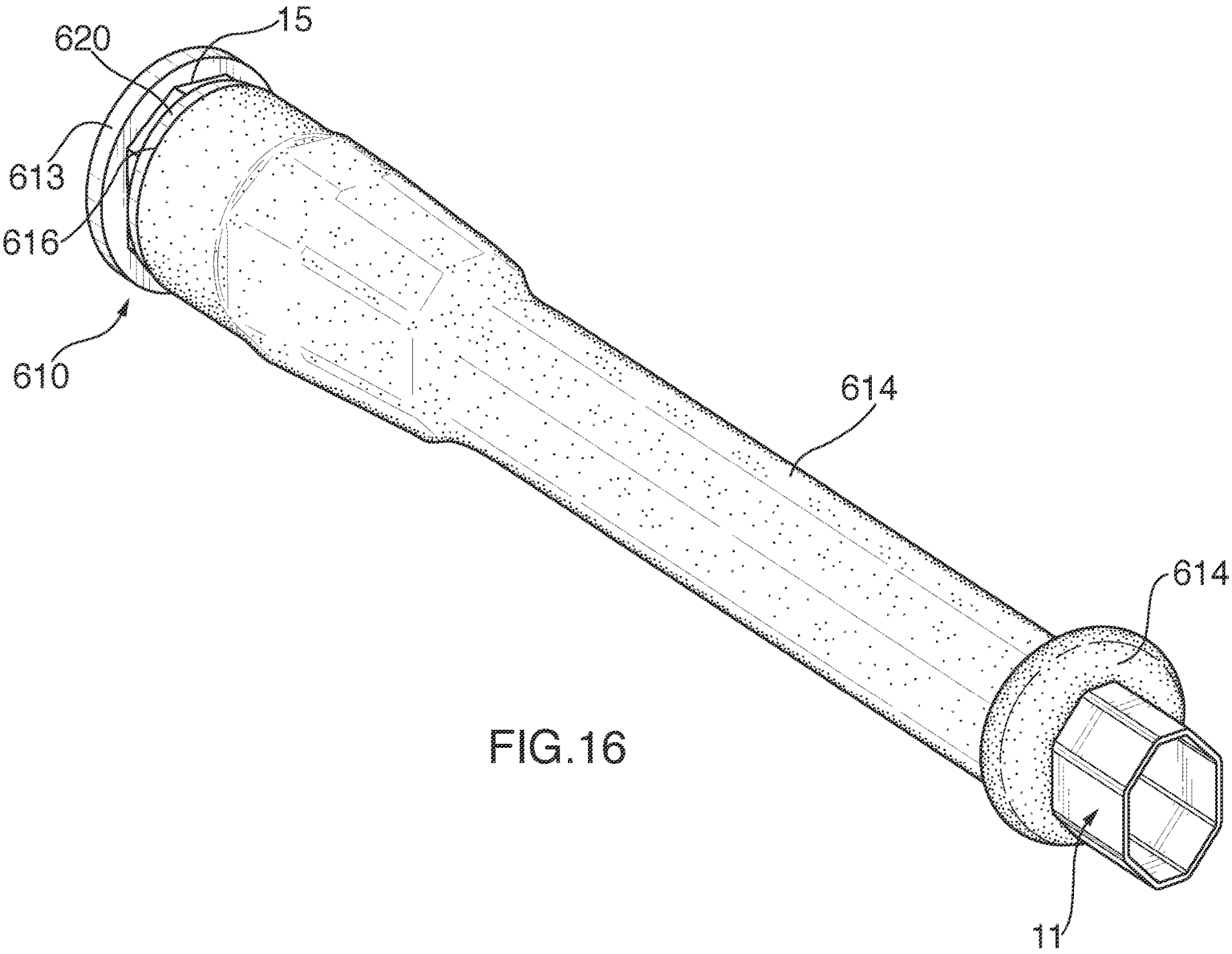
FIG. 16 is a perspective view comparable to FIGS. 13 and 15, but showing the sleeve at an intermediate position as it is being unrolled onto the lacrosse stick shaft.

Referring now to FIGS. 12-17A and 17B, therein illustrated is a seventh embodiment of the invention which as seen best in the exploded and assembled views of FIGS. 12A and 12B comprises a cover 610 which includes a cup-shaped end cap 612 and a relatively thin, resilient, membrane-like, tubular sheath or sleeve 614 which is normally mounted on the cap 612 and, in turn, the shaft 11 of the athletic or sport equipment, in this case (as shown) the shaft 11 of a lacrosse stick in a wrapped, furled or rolled state prior to it being unrolled onto shaft 11. As seen in FIG. 14, sheath 614 has an inner free end 616 preferably coupled to the end cap 612 via a friction fit, as described in greater detail hereinafter. Like the embodiments of FIGS, 1-11, the cap 612 is mounted on the free end or butt 15 of a lacrosse stick 11 in a friction-fit manner and the relatively-thin, resilient, membrane-like sheath 614 is unrolled onto the shaft of the stick 11 as shown in FIGS. 15 and 16 to a desired length, such as shown in the first embodiment in FIG. 5 or the entire length of the shaft as shown in FIG. 6 to thereby, in effect, provide the shaft 11 with a resilient "skin" at least along the section thereof normally used as hand grips by the players.

As before, the cap 612 and sheath 614 are preferably made from injection-molded rubber, synthetic rubber, neoprene or other synthetic plastic polymers that permit production in various thickness, colors and lengths. The elasticity of the material preferably gives it memory and durability. As before the sheath 614 is preferably cylindrical and is dimensioned to enable a friction fit on the shaft 11 of the lacrosse stick which, as shown in FIG. 14, is typically octagonal. The thickness of the cap body 612 is preferably several times thicker than the thickness of the sheath 614. The diameter of the sheath 614 is preferably smaller than the width of the lacrosse stick 11 so that it stretches to a tight fit. After the sheath 614 is unrolled to the desired length, excess material may be cut off, if desired.

However, in this seventh embodiment of the invention as seen best in FIG. 14, the cup-shaped cap 612 has a circular, generally planar end cap 613 which is intended to butt against the free end 15 of the lacrosse stick 11 to prevent the user from injuring his/her hand on the free end 15 of the lacrosse stick 11 which is more prevalently made of metal today. Optionally, the outer face of the planar end cap 613 can be slightly arcuate or domed. Moreover, it is preferably slightly enlarged to create a knob which serves as a stop to ensure that the rolled-up sheath 614 cannot be removed by simply rolling it over and off the free end of the shaft 11. End cap 613 is also relatively thin, preferably having a thickness of about ¼ of an inch or less so that its outer face remains relatively closely adjacent to the end 15 of stick 11 which abuts the inner face of end cap 613, and does not add any significant length to shaft 11 which would interfere with the proper use and handling of the stick or create an unsafe, improper extension thereof.

As further shown in FIG. 14, the octagonally-shaped sidewall of cap 612 may optionally be provided with a recessed inner portion 617 on which a cylindrical, preferably, metallic stiffening ring 620 may be frictionally mounted which serves to stiffen and strengthen the portion of the sidewall of cap 612 on which the furled sheath 614 is normally positioned when not in use and prior to unfurling thereof. As mentioned above, and as seen in FIGS. 13 and 14 the inner end 616 of the 614 sheath is received over and on ring 620 in this recessed section 617 to effect a coupling of the furled sheath 614 to the ring 620 in a friction-fit manner.

The cap 610 is further modified to allow for relatively minor variations in configuration and dimensions of the sport shaft 11 on which it is mounted. More particularly, the tubular side wall 611 of the cup-shaped cap 612 in this embodiment has an octagonal cross-section which is dimensioned and configured to match the octagonal wall of the lacrosse stick shaft 11 so that it fits snugly over and on the octagonal end 15 of the shaft 11 and also in a friction fit manner. The outer portion of sidewall 611 of the cap 612 is provided with a plurality of spaced-apart fingers 618 which defined a plurality of longitudinally-extending slots 619 formed therebetween. The width of the fingers 618 are preferably dimensioned to generally match the width of the octagonal sides of the end of shaft 11 of the lacrosse stick which may vary and the slots 619 are similarly arranged so that they are generally aligned with the seven corners of the octagonal shaft 11. As can be appreciated, the fingers 618 and slots 619 allow some flexibility and sufficient clearance, if needed, if the general dimensions of the respective walls 611 of the cap 612 and shaft 11 are somewhat off relative to one another, thereby allowing the cap 612 to still fit on the end wall 15 of the shaft 11 despite any relatively small variations in its configuration or dimensions.

The reinforcing ring 620 may be needed in situations where the cap 612 is not made of a sufficiently rigid plastic material to stand up to the radially-inwardly-directed force of the furled sheath 614 mounted thereon which might otherwise crush or cause the sidewall of cap 611 to buckle, preventing the end cap 612 from being fully mounted on the end 15 of the lacrosse stick 11, Obviously, if the cap sidewall 611 of the cap 612 is sufficiently rigid and strong enough to resist such deformation as may be caused by the furled sheath 614, the recessed section 617 and stiffening ring or collar 620 would not be needed.

Figure 17A:
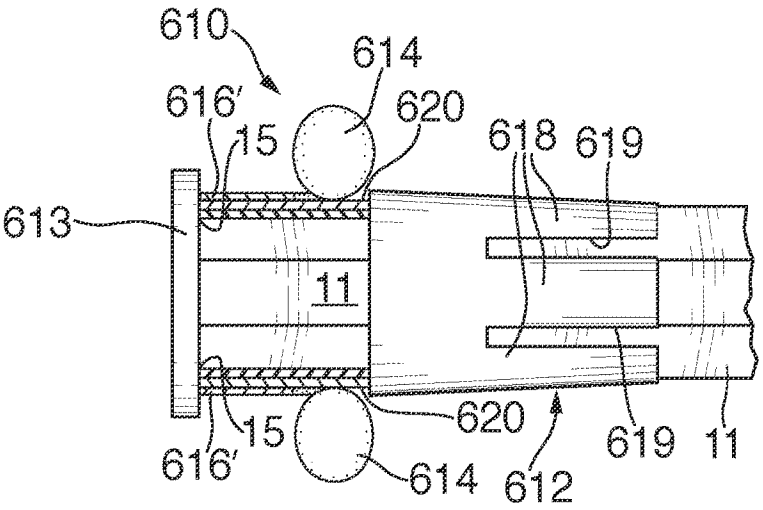
FIG. 17A is a fragmentally-illustrated, side-elevational view, in part section, comparable to that shown in FIG. 14, but showing a variation in the positioning of the inner free end of the rolled up sleeve, when initially mounted on the cap, such that it extends and abuts the inner end face of the enlarged basewall of the cap.
Figure 17B:
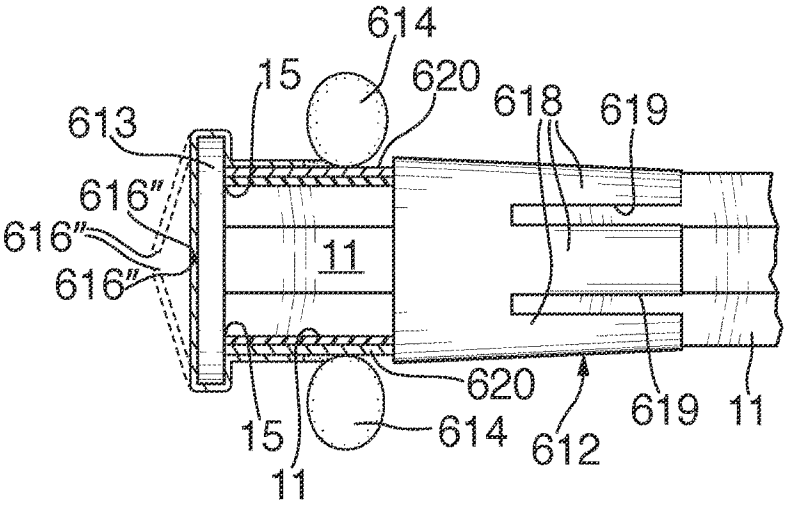
FIG. 17B is a fragmentally-illustrated, side-elevational view, in part section, comparable to that shown in FIG. 14, but showing a further variation in the positioning of the inner free end portion of the rolled up sleeve, when initially mounted on the cap such that it extends over and entirely covers the enlarged basewall of the cap.

FIGS. 17A and 17B show two alternate positions of the placement and disposition of the inner end 616 of sheath 614 as compared to that shown in FIG. 14. In FIG. 17A, the inner end 616' of the sheath 614 extends to the inner end face of the enlarged base or end wall 613 of cup 612 to provide a more neat and finished look, but its position on the sidewall 611 of cup 12 can be varied as desired. FIG. 17B shows a further variation thereof where the free, inner end 616' of sheath 614 extends over and past the enlarged basewall 613 sufficiently to allow the same to collapse inwardly (shown in phantom line), under its normal inherent resilient tendency, causing it to collapse inwardly against the outer face of the end wall 613, such that it lies flat against the outer face of basewall 613, covering most, if not all, thereof typically in a wrinkled, pleated erratic fashion. While the mounting of the sheath is typically adhesive-less, a small amount of glue could be used on the exterior face of the end cap 613 to ensure securement of the inner ends 616" thereto. Alternatively, a disc-shaped or dome-shaped end piece (not shown), having a diameter or width equal to, or less than end wall 613, and having a planar inner face covered with a self-sticking adhesive ply could be glued onto the outer face of end wall 613 for a more clean and fit finish.

Turning now to FIGS, 18A-18E, 19A-19D and 20, therein illustrated in an eighth embodiment of the invention comparable to the seventh embodiment shown in FIGS. 12-17B. More specifically, the cover assembly 700 which also includes a removable resilient sleeve or sheath 714 also includes an end cap 712 having a plurality of spaced-apart, resilient fingers 718 (preferably with two wide fingers and two narrow fingers as before), but in this further embodiment the fingers 718 are disposed for engagement on the inside channel 13 of the lacrosse stick 11 rather than on the outer surface thereof as shown in the prior embodiment. In addition, the cover assembly 700 also preferably includes a plug 730 which also extends through the end cap 712 and into the inside channel 13 of the lacrosse stick 11 adjacent butt end 15 thereof to lock the end cap 712 and, in turn, sleeve 714 in a rigid, fixed position on the handle end 15 of stick 11, as will be described in greater detail hereinbelow.

End plug 730 is of the general type sold by Vertical Lax Inc. of Altamont, New York, which is solely used for locking the end cap 712 in a fixed, non-rotatable manner on the butt end 15 of the handle portion of the lacrosse stick 11, but in this invention it is used to also lock the sheath in place. More specifically, in the present embodiment end plug 730 of the hollow shaft employs a double step 733 consisting of lower step 735 and upper step 736, the latter of which is adjacent its head 732 for engagement with the end cap 712 and for assisting in the removal of the plug 732 when the sheath 714 is to be removed and replaced. In addition, in the present invention, the end cap head 713 has an outer bowl-shaped concave recess 715 in which the end plug head 732 is fully received when installed as more fully described below.

Figure 18A:
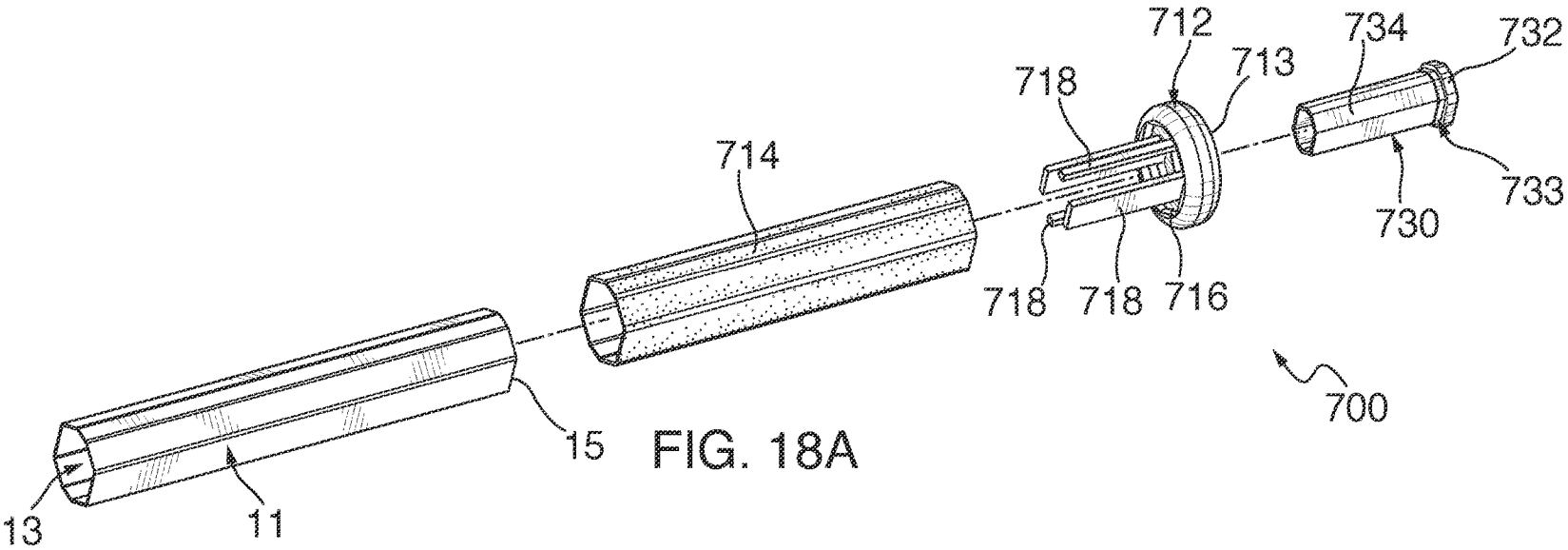
FIG. 18A is an exploded, perspective view of a further embodiment of the invention.
Figure 18C:
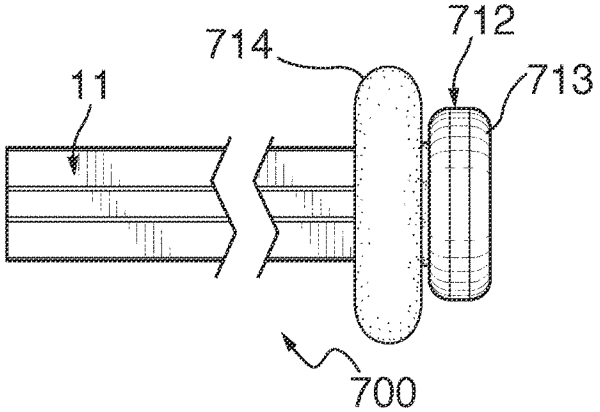
FIG. 18C is an enlarged, side elevational view comparable to that of FIG. 18B, but showing the sheath fully rolled up on the handle portion of the lacrosse stick adjacent to the end cap.
Figure 18B:
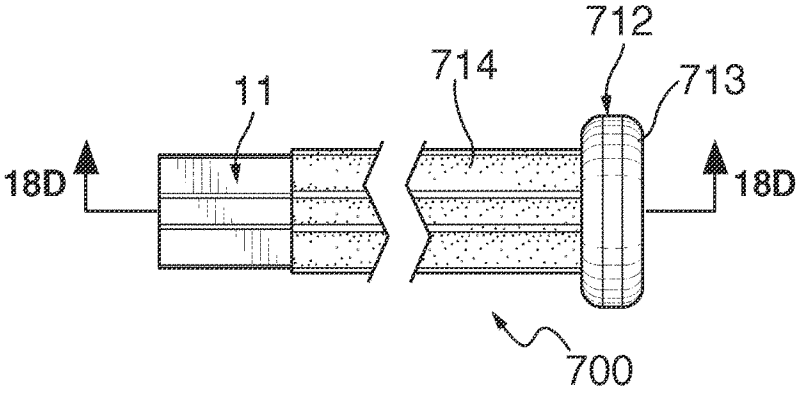
FIG. 18B is a fully assembled side elevational view of the embodiment shown in FIG. 18A.
Figure 18D:
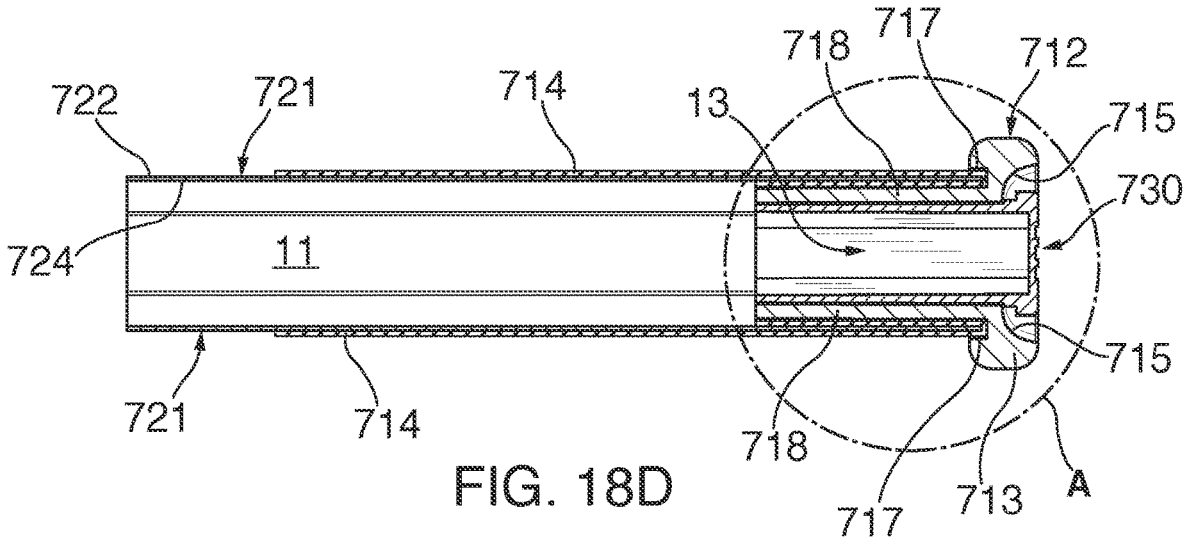
FIG. 18D is an enlarged, sectional view taken along line 18D-18D of FIG. 18B.
Figure 18E:
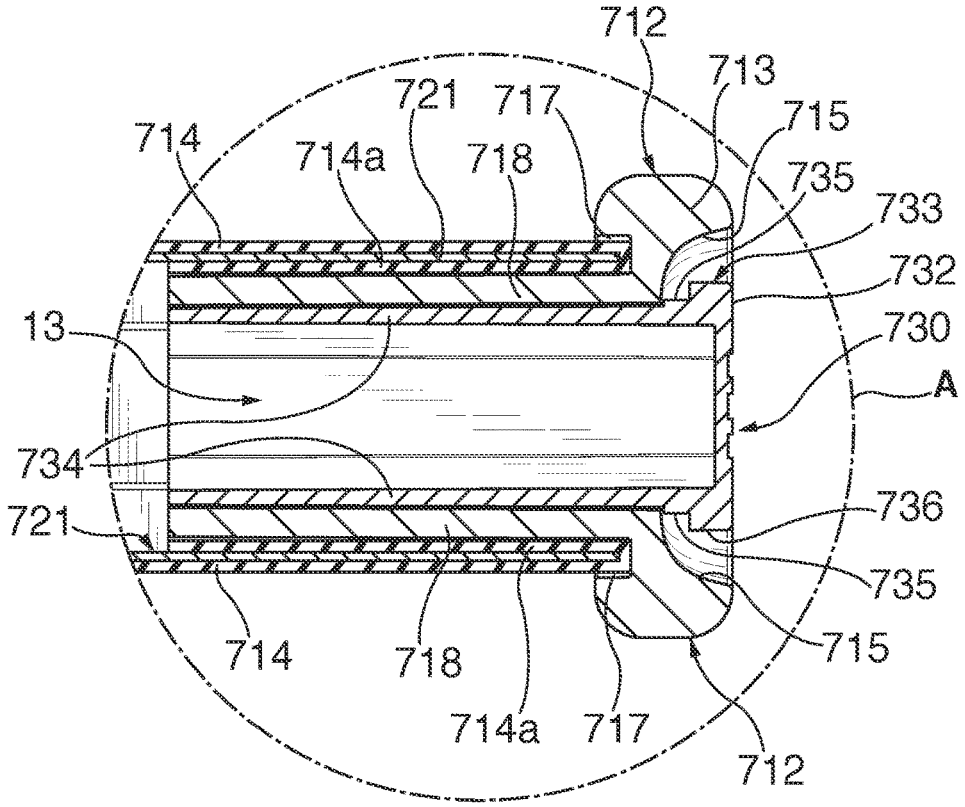
FIG. 18E is a further enlarged, sectional view of detail A shown in FIG. 18D.

FIG. 18A illustrates an exploded view of the handle portion of the lacrosse stick 11 adjacent butt end 15 and the cover assembly 700 which comprises a resilient elastomeric or rubber sheath 714, an end cap 712 and an end plug 730. FIG. 18B illustrates cover 700 in a fully installed state on the handle end portion of the lacrosse stick 11. FIG. 18C shows the sheath 714 rolled up adjacent to end cap 712 prior to being unrolled for deployment onto, or removed for replacement, to the handle portion of the stick 11. FIGS. 18D and 18E further illustrate the manner of engagement of cover assembly 700 and its components sheath 714, end cap 712 and end plug 730, on and within the butt end 15 of stick 11.

As seen best in FIGS. 18D and 18E, the sheath 714 is first received on and adjacent to the butt end 715 of stick 11 with an end portion 714*a* thereof folded inwardly over the butt end 15 of stick 11 and into the inner channel 13 thereof. The remainder of the furled sheath 714 would then be unfurled so that it would lie flat against the entire outer surface 722 of the handle portion 721 of stick 11 in a friction fit or resiliently gripping and fixed manner so as not to move or slip during play. It should be realized that the lacrosse stick 11 would be much longer than that shown in FIG. 18D and that only the inner free end portion of the stick 11 is shown as its opposite outer end would be attached to a lacrosse head as shown in FIGS. 4-9. As defined herein, this inner end portion is simply referred to as the handle portion 721, the entire length of which would normally be covered by sheath 714. However, FIG. 18D shows the outer portion of handle portion 721 uncovered to better enable identification of its outer surface 722 and inner surface 724 in a clearer fashion.

In this embodiment, the end cap 712 comprises an enlarged, rounded, generally donut-shaped end member or annular collar 713 defining an octagonal central opening 716 ringed by preferably, four spaced-apart resilient fingers 718 extending rearwardly therefrom. Fingers 718 are intended to be inserted into the cavity 13 of stick 11 and engage in a spring-like, biasing manner with the inner flap 714*a* (FIG. 18E). Similarly, the inner end portion or flap 714*a* folded over butt end 15 and into cavity 13 would lie flat against the inner surface 724 of handle portion 721 in a resilient manner to hold it rigidly in place as shown. This resilient engagement of the sheath 714 on both the outer side 722 and inner side 724 of the handle portion 721 is enhanced by the provision of an undercut neck portion 717 of the enlarged head 713 of end cap 712 which defines an octagonal slot 716 (FIG. 19D) in which the inner end 15 of handle portion 721 of stick 11 is received together with the snugly-fitting folded over inner end of sheath 714 and its inner-flap 714*a* which are also securely and rigidly received therein.

Furthermore, as further seen in FIGS. 18D and 18E, an end plug 730 is also received with the cavity 13 of stick 11 adjacent its handle free end 15 so as to lock end cap 712 and sheath 714 in a rigid, fixed position. The plug 730 has an enlarged head 732 and a preferably octagonal, tubular shaft 734 joined by a double-step neck portion 733 disposed therebetween. The enlarged, rounded, donut-shaped end cap collar 713 of end cap 712 has a centrally-disposed, bowl-shaped or concave recess 715 in which the head 732 of plug 730 is fully received when installed. As seen best in FIG. 18E, the inner or first step 735 of neck portion 733 is intended to serve as a stop for plug 730 so that, when fully inserted, the head 732 thereof butts up against the step 735 at a position where it is fully recessed within the cavity 715 so as to prevent the head 732 from engaging and injuring the player's hand or causing other bodily harm or injury to another player.

Figure 19A:
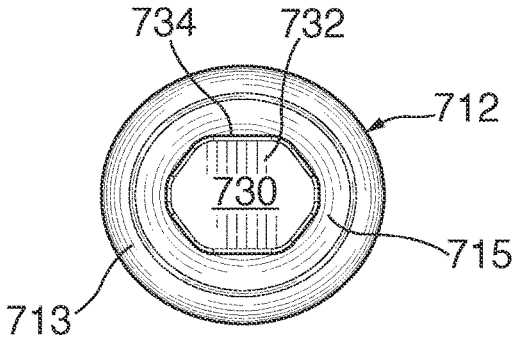
FIG. 19A is an end view of the cover assembly of FIG. 18B mounted on the end of a lacrosse stick.
Figure 19C:
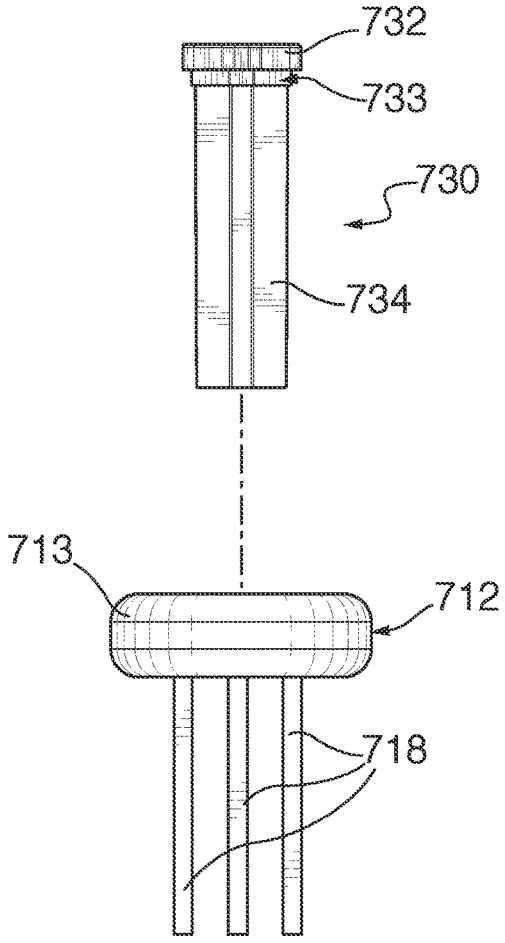
FIG. 19C is an exploded, side elevational view of the end cap and plug comparable to that of FIG. 19B, but rotated 90 degrees relative thereto.
Figure 19B:
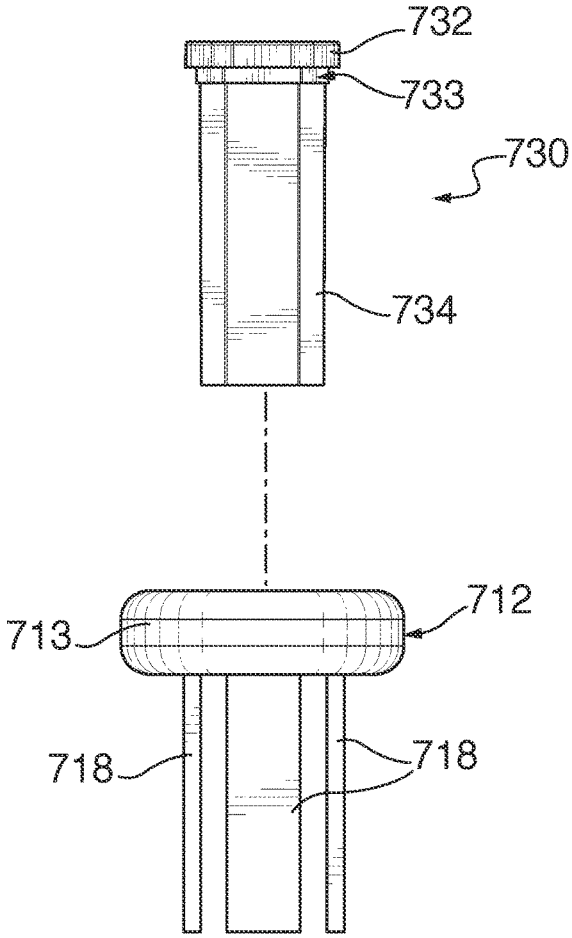
FIG. 19B is an exploded, side elevational view of the end cap and the plug which is to be removably mounted within the end cap.

FIGS. 19A-19D illustrate further details of the end plug 730 and its mating engagement with end cap 712. FIG. 19A is a plan view showing octagonal plug 730 fully inserted within end cap 712. FIG. 19B shows an exploded side view of plug 730 prior to its insertion into end cap 712 thereof (or after removal therefrom).

Figure 19D:
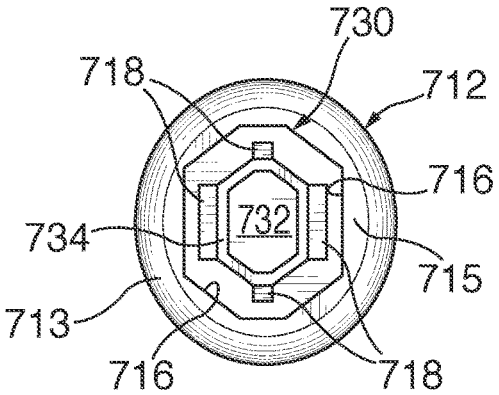
FIG. 19D is a bottom view of the plug fully mounted within the end cap of the cover assembly.
Figure 19F:
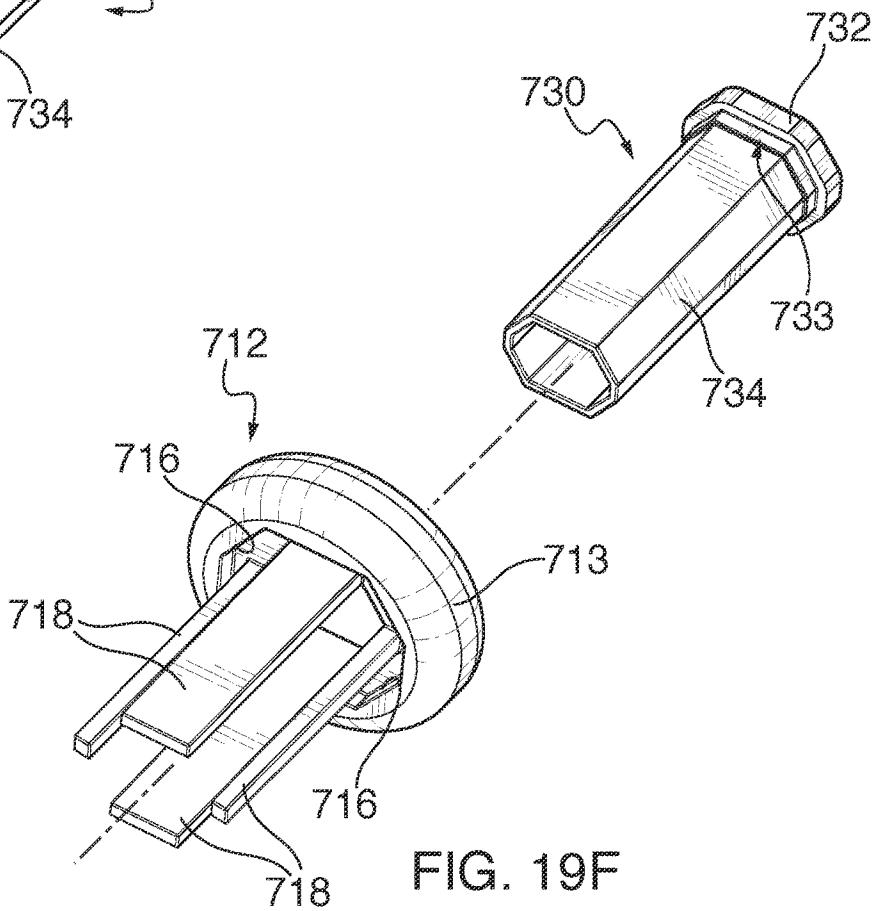
FIG. 19F is an exploded, perspective view of the end cap and the plug which is to be removably mounted with the end cap comparable to that of FIG. 19E, but at a different perspective.
Figure 19E:
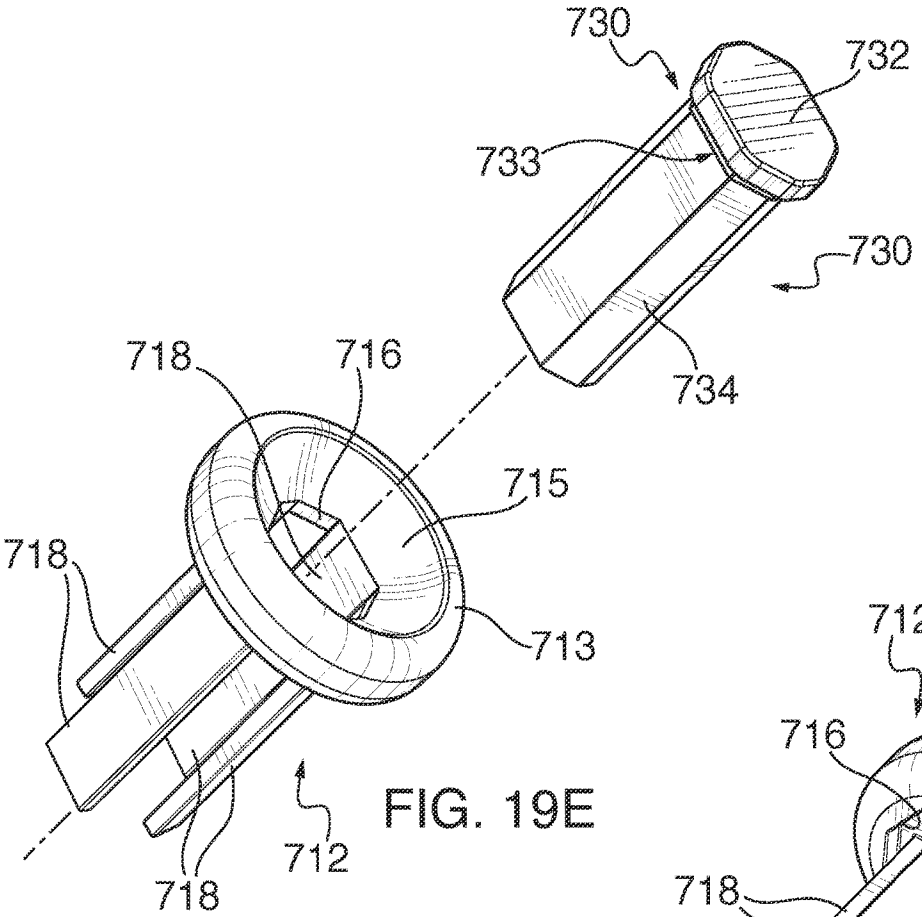
FIG. 19E is an exploded, perspective view of the end cap and the plug which is to be removably mounted within the end cap.

FIG. 19C is similar to FIG. 19B but is rotated 90° relative thereto. FIG. 19D is a bottom view of the end cap 712 and plug 730. FIGS. 19E and 19F provide an exploded perspective view of the plug 730 and end cap 712 at different orientations to better illustrate their manner of engagement and the spatial arrangement of their engageable parts or components. In particular, they better illustrate the intended resilient engagement of the octagonal hollow shaft 734 of plug 730 with the inner sides of fingers 718 of end caps 712 within the octagonal bowl-shaped recess 716 of collar 713 to press the fingers 718 against the sheath flap 714*a* and, in turn, against the inner surface 724 as also seen best in FIG. 18E, to rigidly secure sheath 714 and flap 714*a* on, and in, shaft handle portion 721, respectively.

As a result of this manner of engagement and construction, plug 730 creates an extremely rigid fixed cover assembly which will not twist in the user's hands which is extremely important during play. Moreover, plug 730 and the donut-shaped head portion 713 of end cap 712 are rigidly fixed upon the handle end 15 of lacrosse stick 11 in a manner which prevents user from injuring or slashing his/her hand on the free end 15 of the lacrosse stick which is typically made of metal today.

As a result of the foregoing and in order to use this cover assembly 700, the user would initially unroll the rubber sleeve or sheath 714 from a coiled position (FIG. 18C) onto the end of the handle portion 721 of the lacrosse stick 11 with an inner end flap thereof 714*a* being folded over and into the interior channel 13 of the lacrosse stick handle portion 721 via its free end 15, Subsequently, the end cap 712 is slid onto the outer surface 712 of the handle portion 721 of the lacrosse stick 11 so that its fingers 718 slide into channel 13 and resiliently and frictionally engage the flap 714*a* of the sleeve 714 within the interior channel 13 of the handle portion 721. As can be seen best in FIG. 18E, the plug 730 is then inserted into the central octagonal opening 716 of end cap 712 until its inner step 735 of neck portion 733 engages and abuts the recessed concave surface 715 of end cap 712 to provide a fixed, rigid engagement therebetween to prevent rotation thereof and to lock the cover assembly 700 in place.

When it is decided to remove the sleeve 714 and replace it with another sleeve 714, the user would place an elongated tool, such as a screwdriver or the like (not shown), into the bowl-shaped recess 715 of the enlarged head 713 of the end cap 712 which recess 715 surrounds the plug head 732 and its neck portion 733. By manipulating the screwdriver flat head underneath the second step 736 of the plug 730 and then applying thereto an upward or outward pivoting action, the screwdriver flat head tip engages the second step 735. Then, a further rearward pivoting of the flat head pries the head 732 of the plug upwardly or outwardly so that the plug 730 would disengage from the end cap 712. At that point, the end cap 712 could then also be removed from the cover assembly 700 following which the sheath 714 could then be rolled up and removed. The process can be repeated whenever a new sleeve 714 is needed to be placed on the handle portion 721.

As can be appreciated, various modifications may be made as will be apparent to those skilled in the art. For example, although the end caps are typically round or cylindrical, they could be configured to have a cross-section similar to that of the shaft on which it is mounted, such as octagonal for lacrosse sticks, although other shapes, such as round, oval, rectangular, or hexagonal are also sometimes used, such as for the shafts of other athletic equipment, such as ice hockey and field hockey sticks.

In addition, although the sheaths 614, 714 of the cover may possibly have a thickness of about 1/16 to 1/4 inches, the same can be varied to suit the particular use or application and/or the official sport regulations governing such equipment. In fact, it has been discovered that, most advantageously, the sheath may have a thickness less than ¼ of an inch and even less than 1/16 of an inch, Most advantageously, it has been found that the thickness of the sheath made of extruded rubber is preferably in the range of 0.010 to 0.050 inches and most desirably is about 0.030 inches.

The sheath is preferably made from injection-molded, vulcanized rubber, neoprene of other polymers that permit production in various thicknesses, colors and lengths. The elasticity of the material preferably gives it memory and durability. The diameter of the sheath is preferably smaller than the diameter or width of the shaft of the athletic equipment employed so that it stretches to a tight fit. The enlarged end cap 613 preferably has a diameter of about 1 ½ inches and the sidewall of cap 612 has a length of about 3 inches. The recessed inner portion is preferably about 1 ¼ inches in length and the outer portion of the sidewall is desirably about 1 ¾ inches with the slots having a length of about 1 inch. The cap end wall 613 preferably has an overhang of about ¼" and a thickness or height of about the same. If a further disc-shaped or domed-shaped end piece (not shown) is used to create a neater appearance, it is desirable that the height of the end wall 613 and end piece does not exceed a maximum height of ¾" and preferably, ½" or less, so as not to appreciably extend the effective length of the stick 11. The end cap 712 and plug 730 can be of generally comparable dimensions. For example, the end cap 712 can have a length of about 1 ½-2 inches and the plug can have a similar length of about 1 ½-2 inches. The enlarged generally round or oval head 713 also preferably has a width of about 1 ½ inches.

It should also be realized that although the cover 700 preferably includes both the end cap 712 and plug 730, for certain applications some benefits of the invention may also be achieved by utilizing just the end cap 712 (i.e., without plug 730), but without having a central opening 716 so it entirely covers the free end of the lacrosse stick like the cup-shaped embodiments previously discussed herein.

Thus, while particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

We claim:

1. A removable cover for a lacrosse stick of a type having an elongated hollow shaft having an outer surface and an inner surface and an interior channel extending therethrough and a free end portion with an open end which serves as a handle portion of said lacrosse stick, comprising: an end cap configured and dimensioned to be removably mountable in a friction fit manner on said free end portion of said hollow shaft, said end cap having a head portion and an elongated, resilient hollow body portion attached to said head portion and insertable into said open end of said free end portion of said hollow shaft; and a flexible, resilient, membrane-like, tubular sheath removably mountable on said outer surface of said free end portion of said hollow shaft and movable thereon between a furled position in which said sheath is rolled longitudinally on and along said free end portion of said hollow shaft onto itself to form a rolled-up tubular sheath disposed adjacent to said end cap, and an unfurled position, in which said rolled-up tubular sheath is unrolled longitudinally on and along said outer surface of said free end portion of said hollow shaft, said tubular sheath being dimensioned and configured to create a friction fit when mounted on and along said free end portion of said hollow shaft; wherein said open end of said free end portion of said hollow shaft opens onto said interior channel of said hollow shaft, and said tubular sheath has a free end portion at one end thereof which is foldable over said free end of said hollow shaft and insertable into said interior channel thereof so that it forms a flap which covers and lies over said inner surface of said free end portion of said hollow shaft; and wherein said end cap head is removable securable to said tubular sheath and said foldable end portion thereof and said end cap body portion is configured and dimensioned to resiliently engage and bias said tubular sheath flap against said inner surface of said free end portion of said hollow shaft.

2. The removable cover according to claim 1, wherein said head portion of said end cap is donut-shaped and has a central opening extending therethrough and said hollow body portion thereof defines an interior through passage opening onto said central opening of said end cap head portion, and wherein said removable cover further comprises a removable plug mountable in a friction fit manner in said central opening of said donut-shaped head portion of said end cap which is dimensioned and configured to lock said end cap in a fixed, non-rotatable manner.

3. The removable cover according to claim 2, wherein said plug has a head portion and an elongated shaft portion joined to said head portion.

4. The removable cover according to claim 3, wherein said head portion of said plug is removably mountable in said central opening of said donut-shaped head portion and said elongated shaft portion thereof is insertable into said open end of said free end portion of said hollow shaft and said through interior through passage of said hollow body portion of said end cap, said elongated shaft portion of said plug being dimensioned and configured so that upon insertion it biases said body portion of said end cap against said flap of said resilient tubular sheath and, in turn, against said inner surface of said free end portion of said hollow shaft.

5. The removable cover according to claim 4, wherein said end cap elongated hollow shaft portion comprises a plurality of spaced, apart, flexible, resilient fingers.

6. The removable cover according to claim 4, wherein said donut-shaped head portion of said end cap has an outer portion with a centrally-disposed, bowl-shaped surface formed therein which defines a concave recess adjacent to, surrounding, and opening onto, said central opening thereof.

7. The removable cover according to claim 5, wherein said removable plug has an enlarged head portion which is fully receivable within a concave recess of said head portion of said end cap when mounted thereon.

8. The removable cover according to claim 6, wherein an enlarged head portion of said plug has a flat top surface.

9. The removable cover according to claim 7, wherein said plug has a double- step neck portion disposed between and joined to said plug head portion and said plug shaft, said double-step neck portion having an inner step which serves as a stop and which engages a bowl-shaped surface of said end cap when said plug is fully mounted in said end cap and an outer step spaced from said bowl-shaped surface which serves as a tool placement point to aid removal of said plug.

10. The removable cover according to claim 5, wherein said donut-shaped head portion of said end cap has an inner portion with a recessed channel by which it is removably mountable in a friction-fit manner on said open end of said free end portion of said elongated hollow shaft so that it grips and holds said free end portion of said sheath disposed on said outer surface of said hollow shaft adjacent to said open end of said free end portion of said elongated hollow shaft and so that it also grips and holds said flap thereof disposed in said interior channel of said elongated hollow shaft against said inner surface of said hollow shaft.

11. The removable cover according to claim 10, wherein said elongated hollow shaft of the lacrosse stick is of the type having an octagonal cross-section, and wherein recessed channel and said central opening of donut-shaped head portion of said end cap are octagonally-shaped and wherein said hollow shaft of said plug has an octagonal cross-section.

12. The removable cover according to claim 4, wherein said end cap and said plug are made of plastic and said sheath is made of a flexible elastomeric material.

13. The removable cover according to claim 1, wherein said sheath has a thickness less than ¼ of an inch.

14. The removable cover according to claim 1, wherein said sheath has a thickness in the range of between 0.010 and 0.050 inches.

15. The removable cover according to claim 3, wherein said sheath has a thickness of 0.025 to 0.035 inches.

16. The removable cover according to claim 1, wherein said sheath is cylindrical.

17. The removable cover according to claim 1, wherein said sheath is imprinted.

18. The removable cover according to claim 1, wherein said sheath has a textured outer surface.

19. The removable cover according to claim 1, wherein said sheath is adhesive-less.

20. A lacrosse stick comprising: an elongated hollow shaft having a free end portion with an open end which serves as a handle portion of said hollow shaft, said hollow shaft having an outer surface and an inner surface and an interior channel extending therethrough;

an end cap removably mounted in a friction fit manner on said free end portion of said hollow shaft, said end cap having a head portion and an elongated resilient hollow body portion attached to said head portion and inserted into said open end of said free end portion of said hollow shaft; and a flexible, resilient, membrane-like, tubular sheath removably mounted on said free end portion of said hollow shaft and movable thereon between a furled position in which said sheath is rolled longitudinally on and along said outer surface of said free end portion of said hollow shaft onto itself to form a rolled-up tubular sheath disposed adjacent to said end cap head portion, and an unfurled position, in which said rolled-up tubular sheath is unrolled longitudinally on and along said outer surface of said free end portion of said hollow shaft, said tubular sheath being dimensioned and configured to afford a tight friction fit over the free end portion of the said hollow shaft;

wherein said open end of said free end portion of said hollow shaft opens onto said interior channel of said hollow shaft, and said tubular sheath has a free end portion at one end thereof which is folded over said free end of said hollow shaft and inserted into said interior channel thereof so that it forms a flap which covers and lies over and against said inner surface of said free end portion of said hollow shaft; and wherein said end cap head is removable secured to said tubular sheath and said foldable end portion thereof and said cap body portion serves to resiliently engage and bias said tubular sheath flap thereof against said inner surface of said free end portion of said hollow shaft.

21. The lacrosse stick according to claim 1, further comprising a removable plug, wherein said head portion of said end cap is donut-shaped and has a central opening extending therethrough and said hollow body portion thereof defines an interior through passage opening onto said central opening of said end cap head portion, and wherein said removable cover further comprises a removable plug mountable in a friction fit manner in said central opening of said donut-shaped head portion of said end cap which is dimensioned and configured to lock said end cap in a fixed, non-rotatable manner.

* * * * *